US010316452B2

(12) United States Patent
Lee

(10) Patent No.: US 10,316,452 B2
(45) Date of Patent: Jun. 11, 2019

(54) LAUNDRY TREATMENT APPARATUS

(71) Applicant: LG ELECTRONICS INC., Seoul (KR)

(72) Inventor: Sangyong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/196,634

(22) Filed: Jun. 29, 2016

(65) Prior Publication Data

US 2017/0002496 A1 Jan. 5, 2017

(30) Foreign Application Priority Data

Jun. 30, 2015 (KR) ..... 10-2015-0092783

(51) Int. Cl.

| | |
|---|---|
| ***D06F 37/26*** | (2006.01) |
| ***D06F 37/02*** | (2006.01) |
| ***D06F 39/00*** | (2006.01) |
| ***D06F 37/30*** | (2006.01) |
| *D06F 23/04* | (2006.01) |
| *D06F 37/24* | (2006.01) |

(52) U.S. Cl.

CPC ..... *D06F 37/26* (2013.01); *D06F 37/02* (2013.01); *D06F 37/30* (2013.01); *D06F 39/001* (2013.01); *D06F 23/04* (2013.01); *D06F 37/24* (2013.01)

(58) Field of Classification Search

None

See application file for complete search history.

(56) References Cited

U.S. PATENT DOCUMENTS 3,913,736 A * 10/1975 Brennan ..... D06F 39/001 206/320
4,832,190 A * 5/1989 Favreau ..... B65D 85/68 206/320

(Continued)

FOREIGN PATENT DOCUMENTS

CN 101451294 6/2009
CN 101451295 6/2009

(Continued)

OTHER PUBLICATIONS

Extended European Search Report issued in European Application No. 16176822.1 dated Sep. 26, 2016, 7 pages.

(Continued)

*Primary Examiner* — Jason Y Ko
*Assistant Examiner* — Cristi Tate-Sims
(74) *Attorney, Agent, or Firm* — Fish & Richardson P.C.

(57) ABSTRACT

A laundry treatment apparatus includes a drawer. The laundry treatment apparatus further includes a cabinet that is configured to receive the drawer. The laundry treatment apparatus further includes a tub that is located in the drawer and that defines a space that is configured to receive water. The laundry treatment apparatus further includes a drum that is located in the tub, that is configured to rotate, and that defines a space configured to receive laundry. The laundry treatment apparatus further includes a spacer that is configured to maintain separation between the drawer and the cabinet, that is configured to prevent the drawer from discharging from the cabinet, and that is removable by a user from outside the cabinet while the drawer is in the cabinet.

21 Claims, 5 Drawing Sheets

(56) References Cited

U.S. PATENT DOCUMENTS

| | | | | |
|---|---|---|---|---|
| 2005/0081578 | A1* | 4/2005 | Yoon | D06F 17/06 68/131 |
| 2009/0139273 | A1 | 6/2009 | Kim et al. | |
| 2009/0139275 | A1* | 6/2009 | Kim | D06F 25/00 68/27 |
| 2009/0145174 | A1* | 6/2009 | Kim | D06F 23/02 68/27 |
| 2010/0077801 | A1 | 4/2010 | Son et al. | |
| 2012/0031796 | A1* | 2/2012 | Perini | D06F 39/001 206/521 |
| 2012/0104913 | A1* | 5/2012 | Bak | A47L 15/4268 312/228 |
| 2013/0036773 | A1* | 2/2013 | Choi | D06F 23/04 68/140 |
| 2014/0053612 | A1* | 2/2014 | Son | D06F 29/00 68/28 |
| 2014/0208609 | A1* | 7/2014 | Han | D06F 58/26 34/549 |
| 2014/0238088 | A1 | 8/2014 | Bae et al. | |
| 2014/0366591 | A1 | 12/2014 | Kim et al. | |
| 2015/0059418 | A1 | 3/2015 | Lee et al. | |
| 2016/0073782 | A1* | 3/2016 | Kler Da Silva | A47B 88/16 312/334.44 |

FOREIGN PATENT DOCUMENTS

| | | | |
|---|---|---|---|
| CN | 101578409 | 11/2009 | |
| CN | 101617077 | 12/2009 | |
| CN | 201582277 | 9/2010 | |
| CN | 102844486 | 12/2012 | |
| CN | 102953258 | 3/2013 | |
| CN | 104321481 | 1/2015 | |
| CN | 104420122 | 3/2015 | |
| JP | 2001-148066 | 5/2001 | |
| KR | 10-1414627 | 7/2014 | |
| KR | 10-2015-0025083 | 3/2015 | |
| WO | 2010/040658 | 4/2010 | |
| WO | WO 2010040658 A1 * | 4/2010 | D06F 39/001 |

OTHER PUBLICATIONS

International Search Report and Written Opinion in International Application No. PCT/KR2016/006929, dated Sep. 30, 2016, 20 pages.

Taiwan Office Action in Taiwan Application No. 105118991, dated Jul. 31, 2017, 14 pages (with English translation).

Chinese Office Action in Chinese Application No. 201610506534.0, dated Feb. 1, 2018, 20 pages (with English translation).

Chinese Office Action in Chinese Application No. 201610506534.0, dated Jul. 16, 2018, 19 pages.

Chinese Office Action in Chinese Appln. No. 201610506534.0, dated Feb. 12, 2019, 21 pages (with English translation).

* cited by examiner

LAUNDRY TREATMENT APPARATUS

CROSS REFERENCE TO RELATED APPLICATION

This application claims the benefit of Korean Patent Application No. 10-2015-0092783, filed on Jun. 30, 2015, which is hereby incorporated by reference as if fully set forth herein.

FIELD

The present disclosure relates to a laundry treatment apparatus.

BACKGROUND

Generally, a laundry treatment apparatus is a generic term for an apparatus that washes laundry (e.g., objects to be washed or objects to be dried), an apparatus that dries laundry, and an apparatus that may perform both washing and drying of laundry.

Conventional laundry treatment apparatuses are classified into front loading type laundry treatment apparatuses configured such that laundry is introduced through an introduction opening formed in the front surface of the apparatus, and top loading type laundry treatment apparatuses configured such that laundry is introduced through an introduction opening formed in the upper surface of the apparatus.

Any one of top loading type laundry treatment apparatuses include a cabinet, a drawer provided so as to be discharged from the cabinet, a tub provided in the drawer and having an introduction opening in the upper surface thereof, a drum rotatably provided inside the tub, and a door for opening and closing the introduction opening.

SUMMARY

According to an innovative aspect of the subject matter described in this application, laundry treatment apparatus includes a drawer; a cabinet that is configured to receive the drawer; a tub that is located in the drawer and that defines a space that is configured to receive water; a drum that is located in the tub, that is configured to rotate, and that defines a space configured to receive laundry; and a spacer that is configured to maintain separation between the drawer and the cabinet, that is configured to prevent the drawer from discharging from the cabinet, and that is removable by a user from outside the cabinet while the drawer is in the cabinet.

The laundry treatment apparatus may include one or more of the following optional features. The laundry treatment apparatus includes a lower through hole formed in a bottom surface of the cabinet. The spacer is located in a space between the cabinet and a bottom surface of the drawer and is removable through the lower through-hole. The laundry treatment apparatus includes an upper through-hole formed in an upper surface of the cabinet. The spacer is located in a space between the cabinet and an upper surface of the drawer and is removable through the upper through-hole. The laundry treatment apparatus includes a lower through-hole formed in the bottom surface of the cabinet, a second spacer that is located in a space between the cabinet and a bottom surface of the drawer and that is removable through the lower through-hole. The laundry treatment apparatus includes a lower through-hole formed in a bottom surface of the cabinet; an opening formed in a bottom surface of the drawer; and a second spacer that is located in a space between a bottom surface of the cabinet and the drawer and that is removable through the lower through-hole and the opening. The laundry treatment apparatus includes a stator that is connected to a bottom surface of the tub and that is configured to generate a rotating magnetic field; a rotor that is configured to rotate based on the rotating magnetic field; a rotating shaft that penetrates the bottom surface of the tub and that connects the rotor and the drum; a lower through-hole formed in a bottom surface of the cabinet; an opening formed in a bottom surface of the drawer; and a second spacer that is located in a space between the rotor and the drawer and that is removable through the lower through-hole and the opening.

The laundry treatment apparatus includes a lower through-hole formed in a bottom surface of the cabinet; an opening formed in a bottom surface of the drawer; and a second spacer that is configured to support a bottom surface of the tub, that is removable through the lower through-hole and the opening, and that includes: a support body that is configured to support the bottom surface of the cabinet, and a fixing body that is located on the support body, that is configured to support the bottom surface of the tub, and that is removable through the lower through-hole and the opening. The cabinet and the drawer are configured to receive the second spacer through the lower through-hole and the opening; and receive the fixing body through the lower through-hole and the opening. The laundry treatment apparatus includes a stator that is connected to a bottom surface of the tub and that is configured to generate a rotating magnetic field; a rotor that is configured to rotate based on the rotating magnetic field; a rotating shaft that penetrates the bottom surface of the tub and that connects the rotor and the drum; a lower through-hole formed in a bottom surface of the cabinet; an opening formed in a bottom surface of the drawer; and a second spacer that is configured to support the rotor, that is removable through the lower through-hole and the opening, and that includes: a support body that is configured to support the bottom surface of the cabinet, and a fixing body that is located on the support body, that is configured to support the rotor, and that is removable through the lower through-hole and the opening.

The spacer is configured to use friction to maintain its position in a space between the cabinet and the drawer. The drawer includes a through-hole formed in an upper surface of the drawer. The tub includes a tub body that is configured to receive water and that is configured to receive the drum; a tub cover that defines an upper surface of the tub body and that defines an introduction aperture; and a door that is configured to open and close the introduction aperture. The laundry treatment apparatus includes an upper through-hole formed in an upper surface of the cabinet; and a lower through-hole formed in a bottom surface of the cabinet. The spacer includes a first spacer that is removable through the upper through-hole and that is configured to maintain separation between the cabinet and the door, and a second spacer that is removable through the lower through-hole and that is configured to maintain separation between the cabinet and the drawer. The cabinet is configured to receive the first spacer through the upper through-hole; and receive the second spacer through the lower through-hole. The first spacer is configured to use friction to maintain its position in a space between the cabinet and the door. The second spacer is configured to use friction to maintain its position in a space between the cabinet and a bottom surface of the drawer.

The laundry treatment apparatus includes a stator that is connected to a bottom surface of the tub and that is configured to generate a rotating magnetic field; a rotor that is configured to rotate based on the rotating magnetic field; a rotating shaft that penetrates the bottom surface of the tub and that connects the rotor and the drum; an upper through-hole formed in an upper surface of the cabinet; a lower through-hole formed in a bottom surface of the cabinet; and an opening formed in a bottom surface of the drawer. The spacer includes a first spacer that is removable through the upper through-hole and that is configured to maintain separation between the cabinet and the door; and a second spacer that is located in a space between the rotor and the drawer and that is removable through the lower through-hole and the opening. The first spacer is configured to use friction to maintain its position in a space between the cabinet and the door. The second spacer is configured to use friction to maintain its position in the space between the rotor and the drawer. The laundry treatment apparatus includes a stator that is connected to a bottom surface of the tub and that is configured to generate a rotating magnetic field; a rotor that is configured to rotate based on the rotating magnetic field; a rotating shaft that penetrates the bottom surface of the tub and that connects the rotor and the drum; an upper through-hole formed in an upper surface of the cabinet; a lower through-hole formed in a bottom surface of the cabinet; and an opening formed in a bottom surface of the drawer.

The spacer includes a first spacer that is removable through the upper through-hole and that is configured to maintain separation between the cabinet and the door; and a second spacer that includes: a support body that is configured to support the bottom surface of the cabinet; and a fixing body that is located on the support body, that is removable through the lower through-hole and the opening, and that is configured to support the rotor. The first spacer and the second spacer includes an elastic material. The laundry treatment apparatus includes three or more tub support units that are configured to connect the tub body and the drawer and that each includes: a first support member that is located at the drawer; a second support member that is located at the tub body; and a connector that is configured to connect the first support member and the second support member and that is orthogonal to a bottom surface of the drawer. At least one of the first support members of the three or more tub support units is configured to separate from the drawer.

One object of the subject matter described in this application is to provide a laundry treatment apparatus, which may prevent a drawer from colliding with a cabinet or from being discharged from the cabinet during transportation of the laundry treatment apparatus.

In addition, another object of the subject matter described in this application is to provide a laundry treatment apparatus, which may prevent a drawer from colliding with a cabinet or from being discharged from the cabinet during transportation using a device that is separable from the cabinet after transportation.

In addition, another object of the subject matter described in this application is to provide a laundry treatment apparatus, which may prevent a drum from moving inside a tub during transportation.

In addition, a further object of the subject matter described in this application is to provide a laundry treatment apparatus, which may effectively control vibration of a tub in which laundry is received.

DETAILED DESCRIPTION

Figure 1:
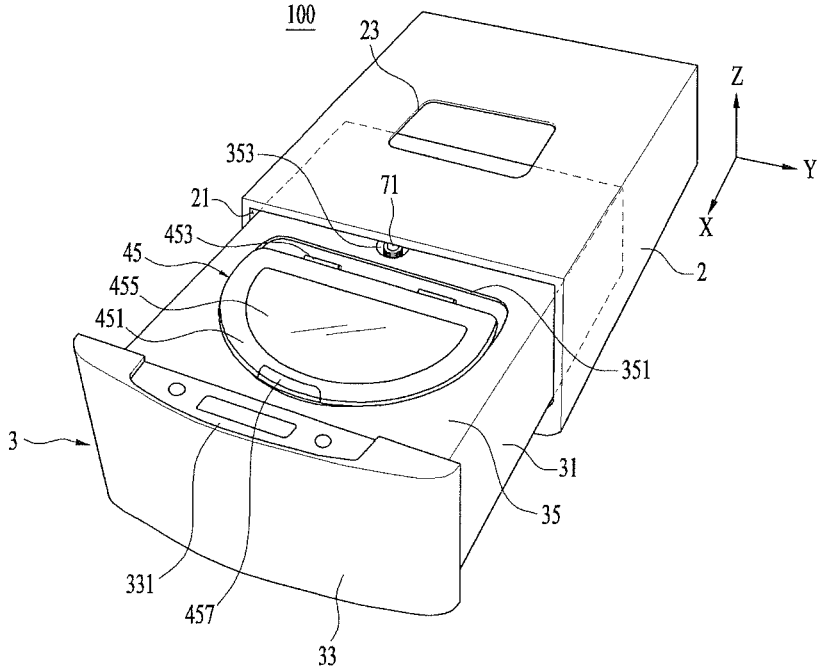
FIGS. 1 and 2 are views of an example laundry treatment apparatus.
Figure 2:
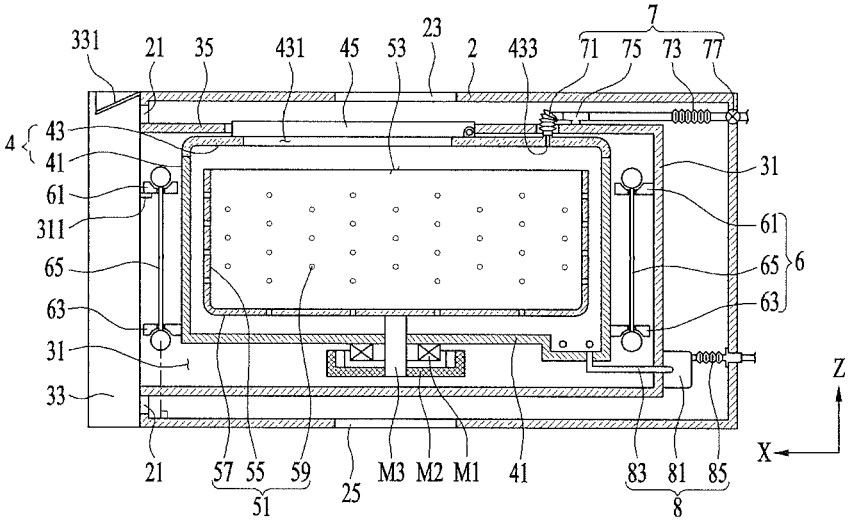
Figure 3:
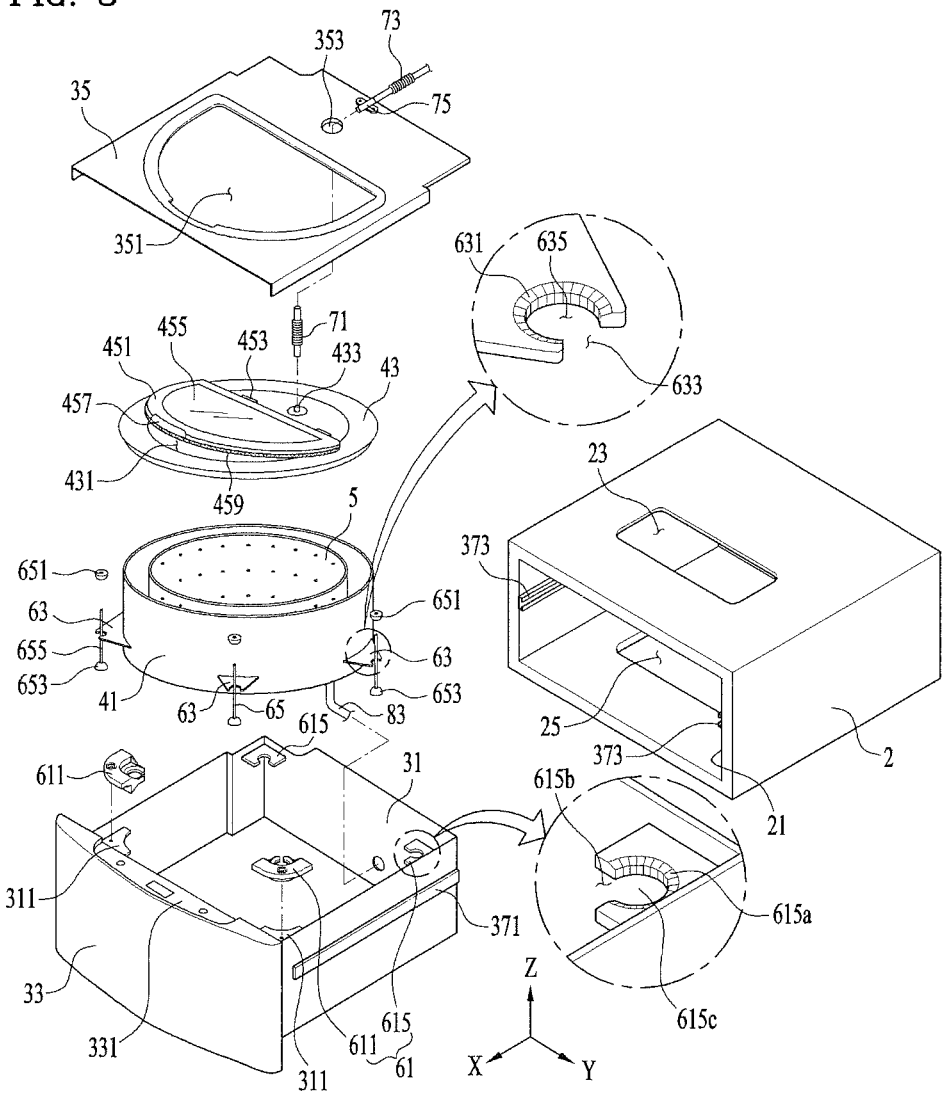
FIG. 3 is a view of an example coupling structure of a drawer, a tub, and a drum.

As illustrated in FIGS. 1, 2 and 3, an example laundry treatment apparatus 100 may include a cabinet 2, a drawer 3 provided so as to be discharged from the cabinet 2, a tub 4 (see FIG. 2) provided inside the drawer 3 for storing water therein, and a drum 5 (see FIG. 3) rotatably provided inside the tub 4 for storing laundry therein.

As illustrated in FIG. 1, the cabinet 2 may serve to define the external appearance of the laundry treatment apparatus 100, and may also serve as a space in which the drawer 3 is received. In some implementations, the cabinet 2 may be provided in the front surface thereof with an opening 21 for the insertion of the drawer 3 (e.g. drawer introduction/discharge opening).

The drawer 3 includes a drawer body 31 configured to be inserted to the inside of the cabinet 2 through the opening 21, a drawer panel 33 fixed to the front surface of the drawer body 31 for opening and closing the opening 21, and a drawer cover 35 for forming the upper surface of the drawer body 31.

Because the drawer panel 33 is fixed to the front surface of the drawer body 31, the drawer panel 33 may serve as a handle for discharging the drawer body 31 from the cabinet 2.

The drawer panel 33 may be provided with a control panel 331, which is used to input a control command associated with the operation of the laundry treatment apparatus 100 and to notify a user of a message associated with the operation of the laundry treatment apparatus 100.

The drawer body 31 may have any shape so long as it can be inserted into the cabinet 2 through the opening 21 and can provide a space in which the tub 4 is received. FIG. 1 illustrates the drawer body 31 having an empty hexahedral shape by way of example.

The drawer 3 may be discharged from the cabinet 2 by a drawer guide. The drawer guide may include a slider 371 fixed to the side surface of the drawer body 31, and a slider receiving member 373 provided inside the cabinet 2 for receiving the slider 371 therein (see FIG. 3).

The drawer cover 35 has a first through-hole 351 and a second through-hole 353 for communicating the inside of the drawer body 31 with the outside. The first through-hole 351 is provided for the introduction and discharge of laundry, and the second through-hole 353 is provided to supply water required to wash the laundry. A detailed description related thereto will follow.

As illustrated in FIG. 2, the tub 4 includes a tub body 41 located inside the drawer body 31 for storing water therein, and a tub cover 43 for forming the upper surface of the tub body 41. The tub body 41 may take the form of a cylinder having an open upper surface.

The tub cover 43 may have an introduction aperture 431 for communicating the inside of the tub body 41 with the outside of the tub body 41, and a supply aperture 433 for introducing water into the tub body 41.

The introduction aperture 431 may be provided so as to communicate with the first through-hole 351 provided in the drawer cover 35, and the supply aperture 433 may be provided so as to communicate with the second through-hole 353 provided in the drawer cover 35. That is, the introduction aperture 431 may be located under the first through-hole 351, and the supply aperture 433 may be located under the second through-hole 353.

The introduction aperture 431 serves to allow laundry to be introduced into the tub body 41, or to allow the laundry inside the tub body 41 to be discharged to the outside of the tub body 41. The introduction aperture 431 is opened and closed by a door 45.

As illustrated in FIG. 3, the door 45 may include a frame 451 rotatably coupled to the tub cover 43 via a hinge 453, a window 455 provided in the frame 451, and a door handle 457 for separably coupling the frame 451 to the tub cover 43. The window 455 may be formed of a transparent material to allow the user to view the inside of the tub body 41.

The drum 5, which is provided inside the tub 4, may include a cylindrical drum body 51 having an opening 53 formed in the upper surface thereof. Because the opening 53 is located below the introduction aperture 431, the laundry supplied through the introduction aperture 431 may be supplied to the drum body 51 through the opening 53.

As illustrated in FIG. 2, a plurality of drum through-holes 59 may be provided in a bottom surface 57 and a circumferential surface 59 of the drum body 51 for communicating the inside of the drum body 51 with the tub body 41.

The drum body 51 may be rotated inside the tub body 41 by a drive unit. The drive unit may include a stator M1 located outside the tub body 41 and fixed to the bottom surface of the tub body 41, a rotor M2 configured to be rotated by a rotating magnetic field provided by the stator M1, and a rotating shaft M3 penetrating the bottom surface of the tub body 41 for connecting the bottom surface 57 of the drum 5 and the rotor M3 to each other. In some implementations, the rotating shaft M3 may be orthogonal to the bottom surface of the tub body 41.

The tub 4 having the configuration described above may be coupled to the drawer body 31 via a tub support unit 6. The tub support unit 6 may include a first support member 61 provided at the drawer body 31, a second support member 63 provided at the tub body 41, and a connector 65 for connecting the first support member 61 and the second support member 63 to each other.

As illustrated in FIG. 3, the connector 65 may include a first connection piece 651 seated in the first support member 61, a second connection piece 653 for supporting the second support member 63, and a bar 655 for connecting the first connection piece 651 and the second connection piece 653 to each other.

The first connection piece 651 may be shaped so as to be movable in the first support member 61 while being seated in the first support member 61. The second connection piece 653 may be shaped so as to support the second support member 63 and to be movable in the second support member 63.

Figure 4:
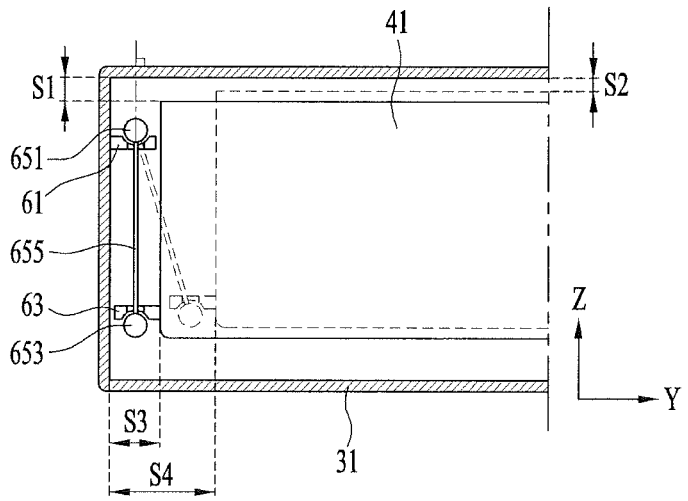
FIG. 4 is a view of an example tub support unit.

FIG. 3 illustrates the first connection piece 651 and the second connection piece 653, which have a semispherical surface in contact with the respective support members 61 and 63 by way of example, and FIG. 4 illustrates the first connection piece 651 and the second connection piece 653, which have a spherical shape by way of example.

As illustrated in FIG. 4, the respective support members 61 and 63 may be provided at a position so that the bar 655 is orthogonal to the bottom surface of the cabinet 2 (e.g. a position so that the bar 655 is orthogonal to the bottom surface of the drawer 3).

In some implementations, because at least three tub support units 6 are provided to couple the tub body 41 to the drawer body 31 and the bars 655 are orthogonal to the bottom surface of the drawer body 31, the distance between the tub cover 43 and the drawer cover 35 may be increased compared to the case where the bars 655 are tilted by a prescribed angle relative to the Z-axis (the height direction of the tub 4) (S1>S2).

In some implementations, the tub support units 6 may reduce the possibility of the tub cover 43 colliding with the drawer cover 35 even if the tub body 41 vibrates inside the drawer body 31.

When the bars 655 are provided so as to be orthogonal to the bottom surface of the drawer body 31, some of the first support members 61 may be separably coupled to the drawer body 31.

When at least three tub support units 6 are provided and the first support members 61 are not separable from the drawer body 31, a worker who attempts to fix the tub body 41 to the drawer body 31 first needs to insert the tub body 41 into the drawer body 31 so as to prevent the first support members 61 from interfering with the second support members 63, and thereafter needs to rotate the tub body 41 so that the second support members 63 and the first support members 61 are located on the vertical axis, in order to couple the first connection pieces 651 to the first support members 61.

Although the feature by which the bars 655 of the tub support units 6 are orthogonal to the bottom surface of the drawer 3 serves to minimize the distance between the outer circumferential surface of the tub body 41 and the inner circumferential surface of the drawer body 31 (S3<S4) so as to minimize the volume of the laundry treatment apparatus 100, the strength of assembly of the first connection pieces 651 and the first support members 61 may be deteriorated while the process described above is performed. This problem may be solved by making some of the first support members 61 be separable from the drawer body 31.

FIG. 3 illustrates an example where four tub support units 4 are provided by way of example. In some implementations, the first support members 61 may include a pair of first brackets 611 arranged on the surface on which the drawer panel 33 is located (e.g. the front surface of the drawer 3), and a pair of second brackets 615 arranged on the rear surface of the drawer 3. When the drawer body 31 has a hexahedral shape, the two first brackets 611 and the two second brackets 615 may be provided at the respective corners of the drawer body 31.

In some implementations, the pair of first brackets 611 may be arranged on the left side surface of the drawer body 31, and the pair of second brackets 615 may be arranged on the right side surface of the drawer body 31.

In some implementations, at least one pair of the first brackets 611 and the second brackets 615 may be separably coupled to body separable coupling pieces 311 fixed to the drawer body 31 (when three tub support units 6 are provided, at least one first support member 61 may be separably coupled to the drawer body 31).

FIG. 3 illustrates an example where the pair of first brackets 611 is separable from the drawer body 31, but the pair of second brackets 615 is not separable from the drawer body 31 by way of example.

When the first brackets 611 are separably coupled to the body separable coupling pieces 311, the coupling of the tub body 41 and the drawer body 31 may be performed as follows.

The worker couples the connectors 65 to the four second support members 63 provided on the circumferential surface of the tub body 41, and then couples a pair of connectors 65, selected from among the fourth connectors 65, to the second brackets 615 arranged on the rear surface of the drawer 3.

Once a pair of the first connection pieces 651 is seated on the respective second brackets 615, the worker may couple the tub body 41 and the drawer body 31 to each other by coupling the first brackets 611 to the two remaining connectors 65, and then fixing the first brackets 611 to the body separable coupling pieces 311.

In some implementations, the laundry treatment apparatus may prevent the possibility of deterioration in the strength of assembly of the tub body 41 and the drawer body 31 by arranging the connectors 65 so as to be orthogonal to the bottom surface of the drawer 3.

In order to improve the strength of assembly of the tub body 41 and the drawer body 31, the first brackets 611 may be integrally formed with the connectors 65. That is, when the tub body 41 and the drawer body 31 are assembled to each other, the first brackets 611 coupled to the first connection pieces 651 may be provided to the worker. Each of the first brackets 611 may include a receiving recess for supporting the first connection piece 651, a through-hole for the penetration of the bar 655, and a connector cover for preventing the first connection piece 651 supported in the receiving recess from being separated from the receiving recess.

In order to ensure that the tub body 41 coupled via the tub support units 6 described above is movable in the X-Y plane, each of the second brackets 615 may include a through-hole 615*c* for the penetration of the bar 655 of the connector 65, a receiving recess 615*a* for supporting the first connection piece 651, and a slit 615*b* for allowing the bar 655 to be inserted toward the center of the through-hole 615*c* from the edge of the through-hole 615*c*.

Figure 5:
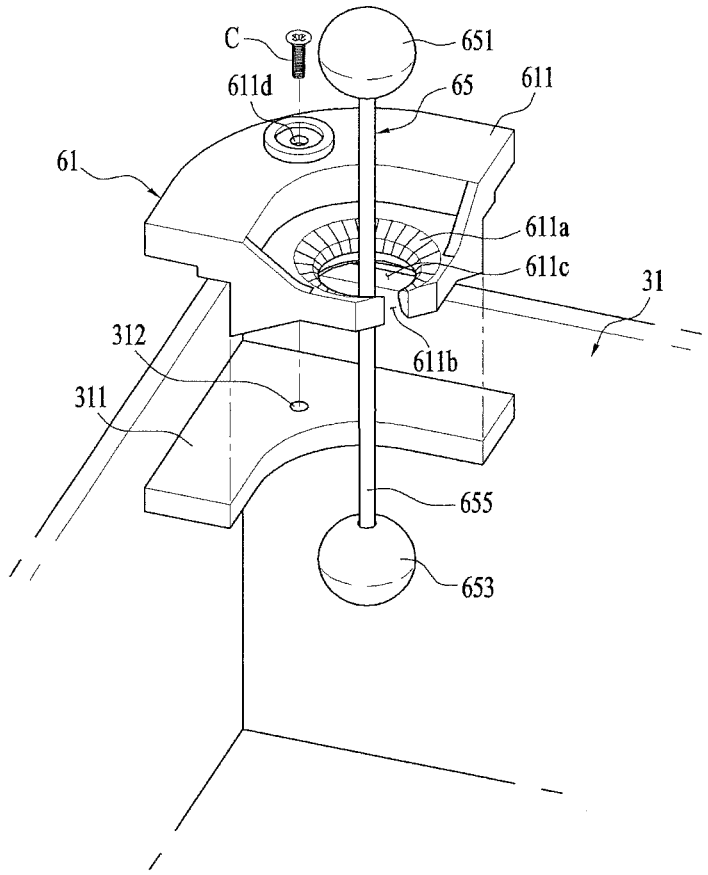
FIG. 5 is a view of an example first support member that is located in a tub support unit.

The first bracket 611 may have the same shape as the second bracket 615. That is, as illustrated in FIG. 5, the first bracket 611 may include a through-hole 611*c* for the penetration of the bar 655 of the connector 65, a receiving recess 611*a* for supporting the first connection piece 651, and a slit 611*b* for allowing the bar 655 to be inserted toward the center of the through-hole 611*c* from the edge of the through-hole 611*c*.

The first bracket 611 may be coupled to the body separable coupling piece 311 via a fastening structure. The fastening structure may include a first fastening hole 611*d* formed in the first bracket 611, a second fastening hole 312 formed in the body separable coupling piece 311, and a coupler C inserted through the respective fastening holes.

The second support member 63 provided at the tub body 41 may include a through-hole 635 (see FIG. 3) for the penetration of the bar 655 of the connector 65, a receiving recess 631 provided on the edge of the through-hole 635 so as to be seated on the second connection piece 653, and a slit 633 for allowing the bar 655 to be inserted toward the center of the through-hole 635 from the edge of the through-hole 635.

The laundry treatment apparatus 100 having the configuration described above may supply water to the tub 4 via a water supply unit 7, and may discharge water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which is controlled by a controller.

In some implementations, unlike the illustration of FIG. 2, the water supply unit 7 may include a single water supply pipe for connecting a water supply source, which is located at the outside of the cabinet 2, to the supply aperture 433 provided in the tub cover 43. In some implementations, at least a region of the water supply pipe may form a corrugated pipe.

The drain unit 8 may include a drain pump 81 fixed to the drawer body 31, a first drain pipe 83 for guiding water inside the tub body 41 to the drain pump 81, and a second drain pipe 85 for guiding water discharged from the drain pump 81 to the outside of the cabinet 2. In some implementations, the second drain pipe 85 may be a corrugated pipe.

Because the laundry treatment apparatus 100 is configured such that the drawer 3 can be discharged from the cabinet 2, it is necessary to prevent the drawer 3 from colliding with the cabinet 2 and to prevent the drawer 3 from being discharged from the cabinet 2 during transportation of the laundry treatment apparatus 100.

In order to prevent the drawer 3 from colliding with the cabinet 2 and to prevent the drawer 3 from being discharged from the cabinet 2 during transportation, the laundry treatment apparatus 100 further includes a spacer, which is separably coupled in a space between the drawer 3 and the cabinet 2.

The spacer may include at least one of a first spacer located in the space between the upper surface of the drawer 3 and the cabinet 2, and a second spacer located in the space between the bottom surface of the drawer 3 and the cabinet 2.

Although the first spacer and the second spacer are interference-fitted in the space between the drawer 3 and the cabinet 2 so as to fix the drawer 3 to the cabinet 2 during transportation, the first spacer and the second spacer may be discharged to the outside of the cabinet 2 through holes formed in the upper surface and the bottom surface of the cabinet 2 after transportation is completed.

Because the tub 4 is supported inside the drawer 3 via the tub support unit 6, the laundry treatment apparatus 100 needs to prevent not only the unwanted discharge of the drawer 3 from the cabinet 2, but also the collision of the tub 4 and the drawer 3 during transportation.

To solve the problems described above, the first spacer may be provided so as to prevent the tub 4 from colliding with the drawer 3 during transportation of the laundry treatment apparatus 100, and the second spacer may be provided so as to prevent the drawer 3 from being discharged from the cabinet 2 during transportation of the laundry treatment apparatus 100.

Figure 6:
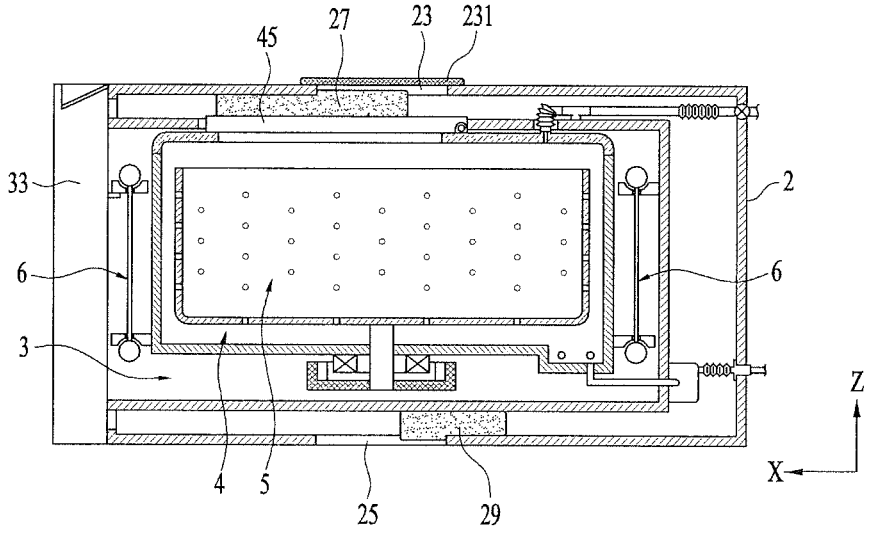
FIGS. 6-8 are views of example spacers.

That is, as illustrated in FIG. 6, the first spacer 27 may be provided so as to maintain the distance between the cabinet 2 and the door 45, and may be separated from the space between the cabinet 2 and the door 45 through an upper through-hole 23 (formed in the upper surface of the cabinet 2).

The second spacer 29 may be provided to maintain the distance between the cabinet 2 and the bottom surface of the drawer 3, and may be separated from the space between the cabinet 2 and the bottom surface of the drawer 3 through a lower through-hole 25 (formed in the bottom surface of the cabinet 2).

The first spacer 27 may be formed of any material so long as it can maintain the distance between the cabinet 2 and the door 45. For example, the first spacer 27 may be formed of an elastic material, such as sponge.

The first spacer 27 may be interference-fitted in the space between the upper surface of the door 45 and the cabinet 2, and may be discharged from the inside of the cabinet 2 to the outside of the cabinet 2 through the upper through-hole 23.

The second spacer 29 may also be formed of an elastic material, such as sponge. The second spacer 29 may be interference-fitted in the space between the bottom surface of the drawer 3 and the cabinet 2.

The second spacer 29 may be inserted to the inside of the cabinet 2 from the outside of the cabinet 2, or may be discharged from the inside of the cabinet 2 to the outside of the cabinet 2, through the lower through-hole 25.

The laundry treatment apparatus 100 may further include an upper through-hole door 231 separably coupled to the cabinet 2 for opening and closing the upper through-hole 23. This serves to prevent impurities from entering the cabinet 2 through the upper through-hole 23 during transportation of the laundry treatment apparatus 100.

In some implementations, the laundry treatment apparatus 100 may further include a lower through-hole door for opening and closing the lower through-hole 25.

Figure 7:
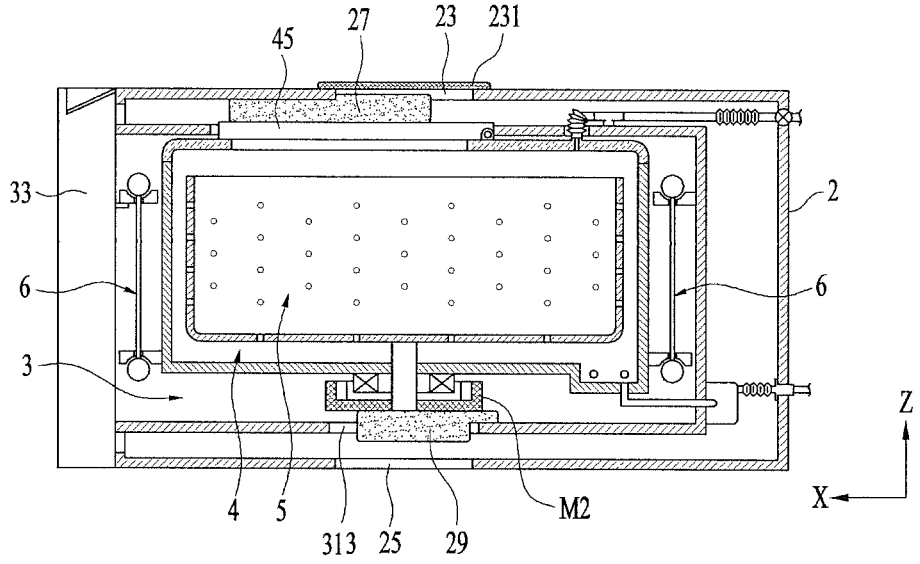
Figure 8:
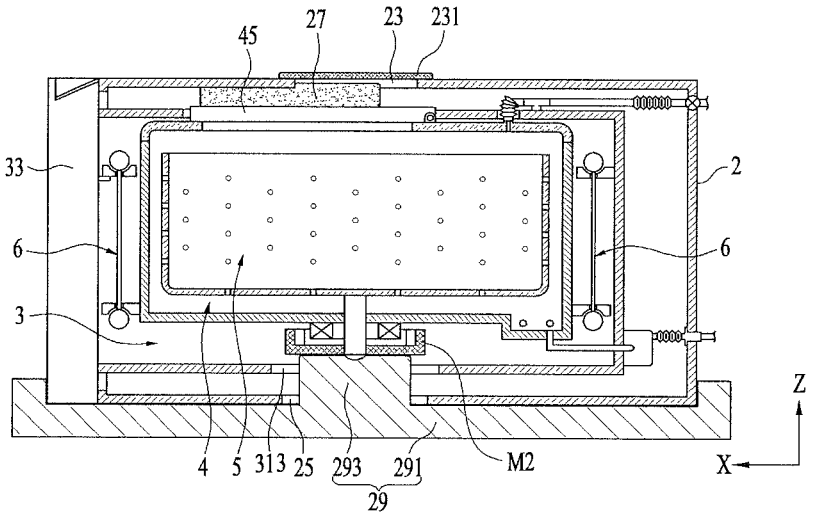

FIGS. 7 and 8 illustrate example spacers. In FIG. 7, the second spacer 29 has the feature of being inserted into the space between the rotor M2 and the bottom surface of the drawer 3 so as to prevent the tub 4 from moving inside the drawer 3 during transportation of the laundry treatment apparatus 100.

That is, the laundry treatment apparatus of FIG. 7 further includes a drawer through-opening 313 formed in the bottom surface of the drawer 3 so as to be located under the rotor M2. The second spacer 29 may have the feature of being interference-fitted in the space between the rotor M2 and the bottom surface of the drawer 3 through the lower through-hole 25 and the drawer through-opening 313.

In some implementations, likewise, a lower through-hole door for opening and closing the lower through-hole 25 may be separably coupled to the bottom surface of the cabinet 2, or a drawer through-opening door for opening or closing the drawer through-opening 313 may be separably coupled to the bottom surface of the drawer 3.

In FIG. 8, the second spacer 29 has the feature of including a support body 291 for supporting the bottom surface of the cabinet 2 and a fixing body 293 protruding from the support body 291 so as to support the rotor M2 for minimizing the movement of the tub 4.

The support body 291 may be provided so as to support the bottom surface of the cabinet 2, e.g. the bottom surface of the entire laundry treatment apparatus 100. The fixing body 293 is inserted into the lower through-hole 25 and the drawer through-opening 313 so as to support the rotor M2. In some implementations, once the laundry treatment apparatus 100 has been seated on the support body 291, some implementations may prevent the tub 4 from moving inside the drawer 3 and may also prevent the drum 3 from moving inside the tub 4 during transportation.

In some implementations, the drawer through-opening 313 may be an opening formed in the bottom surface of the drawer 3. However, when the bottom surface of the drawer 3 is open, the drawer through-opening 313 may be replaced with the open bottom surface of the drawer 3.

In addition, the fixing body 293 may be inserted into the lower through-hole 25 and the drawer through-opening 313 so as to support the bottom surface of the tub 4.

As is apparent from the above description, the laundry treatment apparatus may prevent a drawer from colliding with a cabinet or from being discharged from the cabinet during transportation of the laundry treatment apparatus.

The laundry treatment apparatus may prevent a drawer from colliding with a cabinet or from being discharged from the cabinet during transportation using a device that is separable from the cabinet after transportation.

The laundry treatment apparatus may prevent a drum from moving inside a tub during transportation.

The laundry treatment apparatus may effectively control vibration of a tub in which laundry is received.

What is claimed is:

1. A laundry treatment apparatus comprising:

a drawer;

a cabinet that is configured to receive the drawer;

a tub that is located in the drawer and that defines a space that is configured to receive water;

a drum that is located in the tub, that is configured to rotate, and that defines a space configured to receive laundry; and a spacer that is configured to maintain separation between the drawer and the cabinet, that is configured to prevent the drawer from discharging from the cabinet and that is removable by a user from outside the cabinet while the drawer is in the cabinet, wherein the spacer is a block made of an elastic material that is interference-fitted into a space between the cabinet and the drawer.

2. The laundry treatment apparatus according to claim 1, further comprising a lower through hole formed in a bottom surface of the cabinet, wherein the spacer is located in a space between the cabinet and a bottom surface of the drawer and is removable through the lower through-hole.

3. The laundry treatment apparatus according to claim 1, further comprising an upper through-hole formed in an upper surface of the cabinet, wherein the spacer is located in a space between the cabinet and an upper surface of the drawer and is removable through the upper through-hole.

4. The laundry treatment apparatus according to claim 3, further comprising:

a lower through-hole formed in the bottom surface of the cabinet; and a second spacer that is located in a space between the cabinet and a bottom surface of the drawer and that is removable through the lower through-hole.

5. The laundry treatment apparatus according to claim 3, further comprising:

a lower through-hole formed in a bottom surface of the cabinet;

an opening formed in a bottom surface of the drawer; and a second spacer that is located in a space between a bottom surface of the cabinet and the drawer and that is removable through the lower through-hole and the opening.

6. The laundry treatment apparatus according to claim 3, further comprising:

a stator that is connected to a bottom surface of the tub and that is configured to generate a rotating magnetic field;

a rotor that is configured to rotate based on the rotating magnetic field;

a rotating shaft that penetrates the bottom surface of the tub and that connects the rotor and the drum;

a lower through-hole formed in a bottom surface of the cabinet;

an opening formed in a bottom surface of the drawer; and a second spacer that is located in a space between the rotor and the drawer and that is removable through the lower through-hole and the opening.

7. A laundry treatment apparatus comprising:

a drawer;

a cabinet that is configured to receive the drawer;

a tub that is located in the drawer and that defines a space that is configured to receive water, the tub comprising:

a tub body that is configured to receive water;

a tub cover that defines an upper surface of the tub body and that defines an introduction aperture; and a door that is configured to open and close the introduction aperture;

a drum that is located in the tub, that is configured to rotate, and that defines a space configured to receive laundry;

a lower through-hole formed in a bottom surface of the cabinet;

an opening formed in a bottom surface of the drawer; and a first spacer comprising:

a support body that defines a space to receive the bottom surface of the cabinet, and a fixing body that protrudes from the support body, that is configured to be inserted into the lower through-hold and the opening, that is configured to support the bottom surface of the tub, and that is removable through the lower through-hole and the opening.

8. The laundry treatment apparatus according to claim 7, further comprising:

an upper through-hole that is formed in an upper surface of the cabinet; and a second spacer that is located in a space between the cabinet and an upper surface of the drawer, that is configured to maintain separation between the cabinet and the drawer, and that is removable through the upper through-hole.

9. The laundry treatment apparatus according to claim 7, further comprising:

an upper through-hole that is formed in an upper surface of the cabinet; and a second spacer that is located in a space between the cabinet and the door, that is configured to maintain separation between the cabinet and the door, and that is removable through the upper through-hole.

10. The laundry treatment apparatus according to claim 7, wherein the second spacer is made of an elastic material.

11. The laundry treatment apparatus according to claim 7, wherein the second spacer is made of sponge.

12. The laundry treatment apparatus according to claim 9, wherein the second spacer is configured to use friction to maintain its position in the space between the cabinet and the door.

13. A laundry treatment apparatus comprising:

a drawer that includes a through-hole that is formed in an upper surface of the drawer;

a cabinet that is configured to receive the drawer;

a tub that is located in the drawer and that defines a space that is configured to receive water, the tub comprising:

a tub body that is configured to receive water;

a tub cover that defines an upper surface of the tub body and that defines an introduction aperture; and a door that is configured to open and close the introduction aperture;

a drum that is located in the tub, that is configured to rotate, and that defines a space configured to receive laundry;

a stator that is connected to a bottom surface of the tub and that is configured to generate a rotating magnetic field;

a rotor that is configured to rotate based on the rotating magnetic field;

a rotating shaft that penetrates the bottom surface of the tub and that connects the rotor and the drum;

a lower through-hole formed in a bottom surface of the cabinet;

an opening formed in a bottom surface of the drawer; and a first spacer that includes:

a support body that is configured to support the bottom surface of the cabinet; and a fixing body that protrudes from the support body to support the rotor, that is insertable into the lower through-hole and the opening, and that is removable through the lower through-hole and the opening.

14. The laundry treatment apparatus according to claim 13, further comprising:

an upper through-hole formed in an upper surface of the cabinet; and a second spacer that is configured to be located in a space between the cabinet and the door, that is removable through the upper through-hole, and that is configured to use friction to maintain separation between the cabinet and the door.

15. The laundry treatment apparatus according to claim 14, further comprising three or more tub support units that are configured to connect the tub body and the drawer and that each includes:

a first support member that is located at the drawer;

a second support member that is located at the tub body; and a connector that is configured to connect the first support member and the second support member and that is orthogonal to a bottom surface of the drawer.

16. The laundry treatment apparatus according to claim 15, wherein at least one of the first support members of the three or more tub support units is configured to separate from the drawer.

17. The laundry treatment apparatus according to claim 14, wherein the first spacer and the second spacer are made of an elastic material.

18. The laundry treatment apparatus according to claim 14, wherein the second spacer is configured to use friction to maintain its position in the space between the cabinet and the door.

19. The laundry treatment apparatus according to claim 13, further comprising:

an upper through-hole formed in an upper surface of the cabinet; and a second spacer that is located in a space between the cabinet and an upper surface of the drawer, that is configured to maintain separation between the cabinet and the drawer, and that is removable through the upper through-hole.

20. The laundry treatment apparatus according to claim 7, wherein the first spacer is a block.

21. The laundry treatment apparatus according to claim 13, wherein the first spacer is a block.

* * * * *